United States Patent [19]

Schmale et al.

[11] 3,961,515

[45] June 8, 1976

[54] ALTERNATE SUPPORT FOR A DRAWING DIE MADE OF HARD METAL OR DIAMOND

[76] Inventors: Fritz Schmale, Buchenweg 11, 5990 Altena 8; Hans Theis, Amselweg 3, 6349 Mittenaar,Offenbach, both of Germany

[22] Filed: June 24, 1975

[21] Appl. No.: 589,822

[52] U.S. Cl. ..... 72/285; 72/467

[51] Int. Cl.[2] ..... B21C 3/00

[58] Field of Search ..... 72/285, 467, 60, 253, 72/481, 264–266, 468; 425/381, 192, 188

[56] References Cited

UNITED STATES PATENTS

| | | | |
|---|---|---|---|
| 946,631 | 1/1910 | Ballou | 72/285 X |
| 2,360,746 | 10/1944 | Walker | 72/285 X |
| 3,402,587 | 9/1968 | Lawler | 72/285 |
| 3,436,952 | 4/1969 | Hajikano | 72/467 |

*Primary Examiner*—Milton S. Mehr
*Attorney, Agent, or Firm*—Allison C. Collard

[57] ABSTRACT

Alternate support for a drawing die made of hard metal, in which the drawing die is held with a hollow clamping ring which clamps the drawing die and the support, the drawing die being supported by a shoulder in a bore provided in the support. The drawing die is swingingly supported on the shoulder within the support.

5 Claims, 3 Drawing Figures

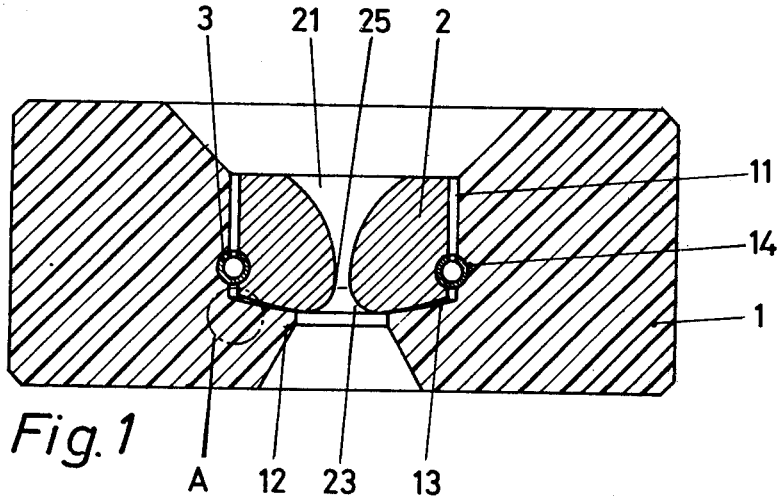
Fig. 1
Fig. 2
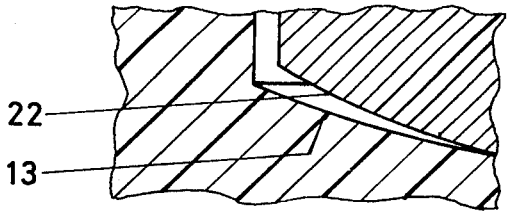
Fig. 3
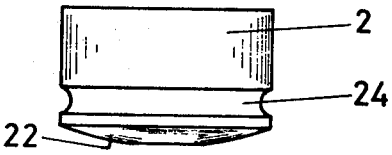

ALTERNATE SUPPORT FOR A DRAWING DIE MADE OF HARD METAL OR DIAMOND

The present invention relates to an alternate or changeable support for drawing dies made of hard metal, or a diamond which seats in the metal having a bore, wherein the die is held with a hollow clamping ring clamping both parts, and is supported by a shoulder extending from the bore. Such drawing dies are mainly used for drawing of wires, in particular in multi-drawing machines.

Heretofore, the drawing dies which preferably consist of sintered carbide hard metal, were imbedded in a brass or steel support. In such a known device, the drawing die is either shrunk or pressed in which assures a secure mounting. The tension forces exerted on the drawing die cannot be precisely predetermined, and therefore, is disadvantageous in the manner that there may occur, for example, irregular deforming or oblique positioning of the die.

An alternate support is known from German Pat. No. 458,320, wherein a groove is provided in the support or in the die for receiving a hollow clamping ring which clamps both parts. Such a connection between the die and the support permits a certain balancing of the axial direction of the die with respect to the drawing direction of the wire. Furthermore, the support is protected against the very high operating temperatures.

It is therefore an object of the present invention to obtain an automatic balance between a not fully perpendicular drawing die relative to the drawing direction of the wire, and thereby to improve the quality of the drawn wire by obtaining a wire which is more uniform.

In order to obtain this object of the invention, an alternate support of the above-mentioned type is provided wherein the drawing die is swingingly supported on the shoulder within the support.

In a preferred embodiment of the present invention, the drawing die is formed convex at its output aperture. The support at the shoulder is concave and thus, a greater bending radius than the bending radius of the output opening of the drawing die. Such a mounting of the drawing die permits the drawing die to adjust perpendicularly with respect to the wire drawn therethrough. Therefore, the wire is rather free of twist. A one-sided wear and tear of the drawing die is also eliminated.

The mounting of the drawing die within the alternate support and the resulting possibility of heat emission by means of a cooling or a lubrication solvent, also permits one to employ a heat resistant plastic material for the alternate support.

The present invention also proposes to place boron on the drawing die at their claimed inner faces. This boron coating is made possible as a consequence of the removability of the drawing die from the support, because the coating with boron takes place under very high temperatures, which supports made of steel, plastic or brass should not be subjected to.

Other objects and features of the present invention will become apparent from the following detailed description considered in connection with the accompanying drawing which discloses several embodiments of the invention. It is to be understood, however, that the drawing is designed for the purpose of illustration only and not as a definition of the limits of the invention.

In the drawing, wherein similar reference characters denote similar elements throughout the several views:

FIG. 1 is a sectional view in enlarged scale through an alternate support with drawing die in accordance with the present invention;

FIG. 2 is an enlarged section of the portion of FIG. 1; and

FIG. 3 is an enlarged view of a drawing die.

Referring now to FIGS. 1–3, in accordance with the invention, an alternate support 1 comprises a heat resistant plastic material. A shoulder 12 is formed in the center bore of the support and the drawing die 2 is swingingly supported on the shoulder 12. The drawing die 2 is made of a hard metal. The output side 22 with the output funnel 23 of the drawing is convex. Accordingly, the support face 13 of the shoulder 12 is concave having a greater radius of curvature than the radius of curvature of the output side 22 of the drawing die 2.

A hollow clamping ring 3 clamps the support 1 and the drawing die 2. The clamping ring 3 engages in a groove 14 in the support and the circumferential groove 24 on the drawing die 2. This type of mounting of the drawing die 2 and the swinging support on the shoulder in the support 1 makes possible a sufficient pitch or inclination of the drawing die with corresponding admission to the axial or drawing direction, respectively. Thereby, the axis of the drawing die automatically adjusts to the drawing direction, whereby the quality of the drawn wire is extremely twist free and a constant cross diameter having a constant diameter is achieved.

In order to increase wear resistant to the wear of the inner bore 21, it is essential to boron the inner faces 25 totally or partly. Since the drawing die 2 can be removed from the alternate support, this boron coating can be repeated over and over again. The boron coating results in an extreme wear resistant surface and results in a high operating cycle for the tools.

While only one embodiment of the present invention has been shown and described, it will be obvious to those skilled in the art that many changes and modifications may be made thereunto without departing from the spirit and scope of the invention.

We claim:

1. An alternate support for a drawing die made of hard metal, comprising:

a support having a bore formed with a shoulder, and hollow clamping ring means for clamping a drawing die and said support, and the drawing die being supported by said shoulder in said bore in said support, said drawing die being swingingly supported on said shoulder within said support.

2. An alternate support according to claim 1, wherein the drawing die is convex at its output side.

3. An alternate support according to claim 1, wherein said drawing die has an output side defining a radius of curvature, and said shoulder has thereon a concave support face having a greater radius of curvature than the radius of curvature on the output side of said drawing die.

4. An alternate support according to claim 1, wherein said support is made of a heat resistant plastic material.

5. An alternate support according to claim 1 wherein said drawing die has inner faces which are boroned.

* * * * *